US011136785B2

(12) United States Patent
McClure et al.

(10) Patent No.: US 11,136,785 B2
(45) Date of Patent: Oct. 5, 2021

(54) ELEVATOR FIXTURE MAGNETIC SLIDE LATCH AND CONTROL BOX EQUIPPED THEREWITH

(71) Applicant: Innovation Industries Inc., Russellville, AR (US)

(72) Inventors: Sam Jeremy David McClure, Belleview, AR (US); Jake Dalton Tyler, Atkins, AR (US)

(73) Assignee: Innovation Industries Inc., Russellville, AR (US)

( * ) Notice: Subject to any disclaimer, the term of this patent is extended or adjusted under 35 U.S.C. 154(b) by 564 days.

(21) Appl. No.: 16/135,194

(22) Filed: Sep. 19, 2018

(65) Prior Publication Data

US 2019/0093389 A1 Mar. 28, 2019

Related U.S. Application Data

(60) Provisional application No. 62/561,968, filed on Sep. 22, 2017.

(51) Int. Cl.
*E05B 15/00* (2006.01)
*E05B 47/00* (2006.01)
(Continued)

(52) U.S. Cl.
CPC ..... *E05B 15/0073* (2013.01); *B66B 1/466* (2013.01); *E05B 47/004* (2013.01);
(Continued)

(58) Field of Classification Search
CPC ..... E05B 15/0073; E05B 47/004; E05B 65/0089; B66B 1/466; B66B 1/462; B66B 3/002; E05C 19/163; E05C 19/16; E05C 19/166; E05C 19/168; H01F 7/00; Y10S 292/68
(Continued)

(56) References Cited

U.S. PATENT DOCUMENTS 2,508,305 A * 5/1950 Teetor ..... E05C 19/16 292/251.5
2,809,062 A * 10/1957 Mainhardt ..... E05B 47/004 292/144
(Continued)

*Primary Examiner* — Kristina R Fulton
*Assistant Examiner* — Tal Saif
(74) *Attorney, Agent, or Firm* — Stephen D. Carver

(57) ABSTRACT

An elevator call box with internal, concealable latching mechanism comprises an internally disposed, cylindrical magnetic pin with a relatively low pull force that is slidably displaceable by an larger, external magnetic force supplied by a service technician. When the access door is closed, magnetic pin penetrates an orifice in a locking tab to lock the call box. The pin magnet is normally attracted to an adjacent, magnetically attractive clip snap-fitted to a latching block. The latch is externally disengaged via a stronger portable magnet carried by service personnel. The larger magnetic pull force of the portable magnet slidably displaces the smaller magnetic latch pin, freeing the locking tab to permit pivotal opening of the access door. Once the stronger magnet is moved away, the smaller magnetic pin, which is attracted magnetically to the clip, will return to it's rest position penetrating the locking tab and locking the control.

19 Claims, 10 Drawing Sheets

(51) Int. Cl.

| | |
|---|---|
| ***B66B 1/46*** | (2006.01) |
| ***E05C 19/16*** | (2006.01) |
| *B66B 3/00* | (2006.01) |
| *E05B 65/00* | (2006.01) |

(52) U.S. Cl.
CPC ..... *E05C 19/163* (2013.01); *B66B 1/462* (2013.01); *B66B 3/002* (2013.01); *E05B 65/0089* (2013.01)

(58) Field of Classification Search
USPC ..... 292/251.5, 137, 138, 144, DIG. 11; 70/276
See application file for complete search history.

(56) References Cited

U.S. PATENT DOCUMENTS 2,853,331 A * 9/1958 Teetor ..... E05C 19/16 292/251.5
3,744,833 A * 7/1973 Berducone ..... E05B 47/0038 292/251.5
4,848,812 A * 7/1989 Slaughter ..... E05C 19/163 292/144
5,377,662 A * 1/1995 Mills ..... F24H 9/02 126/11 OR
5,485,733 A * 1/1996 Hoffman ..... E05B 47/004 70/276
5,780,790 A 7/1998 Benson
5,829,554 A 11/1998 Benson
6,845,850 B1 1/2005 Schneck
6,945,735 B1 * 9/2005 Doverspike ..... F16L 1/09 248/207
7,044,509 B2 * 5/2006 Radel ..... E05B 63/128 292/106
7,152,831 B2 * 12/2006 Riedy ..... F16L 3/221 248/68.1
8,746,415 B2 6/2014 Aluisetti
8,998,660 B2 * 4/2015 Bakos ..... H05K 3/325 439/878
9,911,880 B2 * 3/2018 West ..... F24S 25/65
2012/0031708 A1 * 2/2012 Aluisetti ..... B66B 1/468 187/380
2018/0226918 A1 * 8/2018 De Vogel ..... H02S 20/20

* cited by examiner

ELEVATOR FIXTURE MAGNETIC SLIDE LATCH AND CONTROL BOX EQUIPPED THEREWITH

CROSS REFERENCE TO RELATED APPLICATION

This utility conversion patent application is based upon, and claims the benefit of the filing date of a U.S. Provisional Patent application, Ser. No. 62/561,968, filed Sep. 22, 2017, by coinventors Sam Jeremy David McClure and Jake Dalton Tyler, which was entitled "Elevator Fixture Magnetic Slide Latch."

BACKGROUND OF THE INVENTION

I. Field of the Invention

The present invention generally relates to the service and maintenance of elevator controls rendered by service personnel and technicians. More particularly our invention is directed to secured electrical elevator control boxes with internal latching.

II. Description of the Prior Art

Control housings for elevators are well known in the art. Typical control housings are disposed upon building walls adjacent to elevators doors. The control housings mount various passenger-activated selection switches, and protectively enclose switch wiring and associated circuitry.

Elevator controls typically comprise up and down indicators, selector buttons, and "master" or "fireman" key switches. Typically the housings also display informational material such as warnings, instructions and the like. Displayed information often depends upon local regulations and building requirements. The internal components inside elevator control housings require regular and routine maintenance.

Many modern elevator control housings include faceplates that are selectively locked with an internal latching mechanism. Mechanically operated means triggered by a service key are used to release the compression latching mechanism for service. Typical prior art elevator control latching mechanisms thus require the service personnel to carry appropriate keys or unlatching accessories that can complicate and slow down service.

Prior U.S. Pat. No. 5,780,790, issued Jul. 14, 1998, and owned by Innovation Industries Inc., discloses a modular elevator switch control housing comprising an elongated casing disposed adjacent an elevator. The interior of the housing is exposed during maintenance or service by removing the top or bottom cover and sliding out faceplates which are mounted within opposed grooves defined in opposite sidewalls.

Prior U.S. Pat. No. 5,829,554 issued Nov. 3, 1998, discloses a hinged elevator control housing, comprising faceplates that can be folded open to quickly expose the housing interior for service. Each housing is generally in the form of a low profile, generally rectangular enclosure that is conveniently placed on a wall adjacent to an elevator car access position. The housing protectively encloses elevator operational controls, directional indicators, warning lights, and the like. In an alternative embodiment sliding grooves adjustably receive individual sliding display panels that jointly form the faceplate in cooperation with an adjacent folding panel, and interior brackets secured to the subframe mount astragals that form a border between adjoining faceplate panels.

U.S. Pat. No. 8,746,415 issued Jun. 10, 2014, and entitled "Magnetic lock for a control unit in an elevator installation", discloses a control unit for elevators comprising a cover, base, and a lock that can secure the cover to the base or release it from the base. The lock comprises a locking bar that is movable back and forth between a closed position and an open position by movement of a magnetic lock on a surface of the cover. The locking bar with the magnet is stabilized in a closed position by a first magnetic element to lock the cover. The locking bar with the magnet is stabilized in an open position by a second magnetic element wherein the cover is released. Unfortunately the requirement of twin magnets complicates the device and increases the expense of manufacture.

SUMMARY OF THE INVENTION

A secure elevator call box comprises a secured control box housing that is internally latched through an interiorly displaceable magnet. The call box protectively encloses elevator call switches, indicators, displays, controls or other desired electrical or mechanical components known in the art.

The magnetically operable elevator control box comprises a rigid, flat mounting plate adapted to be flushly mounted on a wall adjacent an elevator car entryway for support. A hinged access door with a peripheral lip is pivotally coupled to the mounting plate to enclose the box interior. The normally locked access door is releasably secured by a latching system including an interiorly displaceable magnet, which is displaced between latching and unlatching positions by service personnel with a larger and more powerful magnet.

The latching device within the preferred box may easily be retrofitted to existing control housings without significant modifications or alterations to the mounting surface. Each unit mounts over an existing control outlet, but each housing may be originally installed during building construction.

The preferred latching system comprises a plastic latching block that is secured within the box, preferably mounted to the edge of the access door. The resilient latching block comprises an integral pair of spaced apart, diverging prongs disposed on opposite sides of a clip-seating slot. In-turned lips are defined on the prong edges. A resilient, preferably metallic clip is adapted to be snap-fitted to the block. Each clip comprises a central body portion with a pair of integral, outwardly diverging, deflectable wings on each end. The wings terminate in spaced apart wing locks disposed on opposite sides of a transverse wing slot. The clip can be snap-fitted to the block by centering and pressing the clip central portion between the block prongs, such that the clip central body portion yieldably enters the block clip-seating slot. When pushed in properly the clip will snap into place as the clip wings compress slightly in response to the block prongs. Then the clip wings will snap back into place, with the clip central body portion entering the block clip-seating slot, and with the in-turned lips of the block prongs retaining the clips against a vertical motion by engaging the clip wing slots. At this time the block prongs will be positioned within the clip's wing slots, with the clip locks disposed on either side of the block prongs to restrain lateral movements.

Preferably the latch comprises an internal, magnetic locking pin that can lock down the unit during normal operation. The locking pin is slidably secured within a through bore penetrating the block, that perpendicularly penetrates a locking recess defined in the block. The mounting plate has a projecting, apertured tab that, when the access door is closed, enters the locking recess in the block. The magnetic locking pin is normally magnetically attracted to the clip, penetrating a tab aperture to lock the access door against the mounting plate. The door can be released to unlock the control box by displacing the magnetic locking pin with an external, rare earth magnet carried by service personnel. Such a magnet preferably exhibits a nineteen-pound pull, which is sufficient to overcome the attractive pull of the magnetic pin within the block towards the clip.

Thus, a primary object of the present invention is to provide a modular elevator control housing that can be quickly opened during service by a portable, external magnet.

A related object of our invention is to allow quick access to the internal components located within an elevator control housing for routine maintenance and repairs, or the replacement of internal components.

Another object is to provide a magnetic latch that improves the security of elevator control housings.

Yet another object is to provide a quality aesthetic appearance. Features of our invention, including a decorative faceplate and appropriate trim, are mechanically integrated with the magnetic actuation structure.

Another primary object is to simplify the opening of elevator controls, including control housing faceplates.

An additional object of our invention is to simplify and speed up maintenance chores by facilitating quick unlocking of the unit to subsequently permit access to the interior of the housing.

Still another object of the present invention is to provide an elevator control housing that easily retrofits over preexisting elevator controls without substantial modifications.

Another object is to provide an elevator control housing that mounts over existing electrical boxes or fixtures without requiring the installer to cut the wall.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE SEVERAL VIEWS OF THE DRAWINGS

Figure 1:
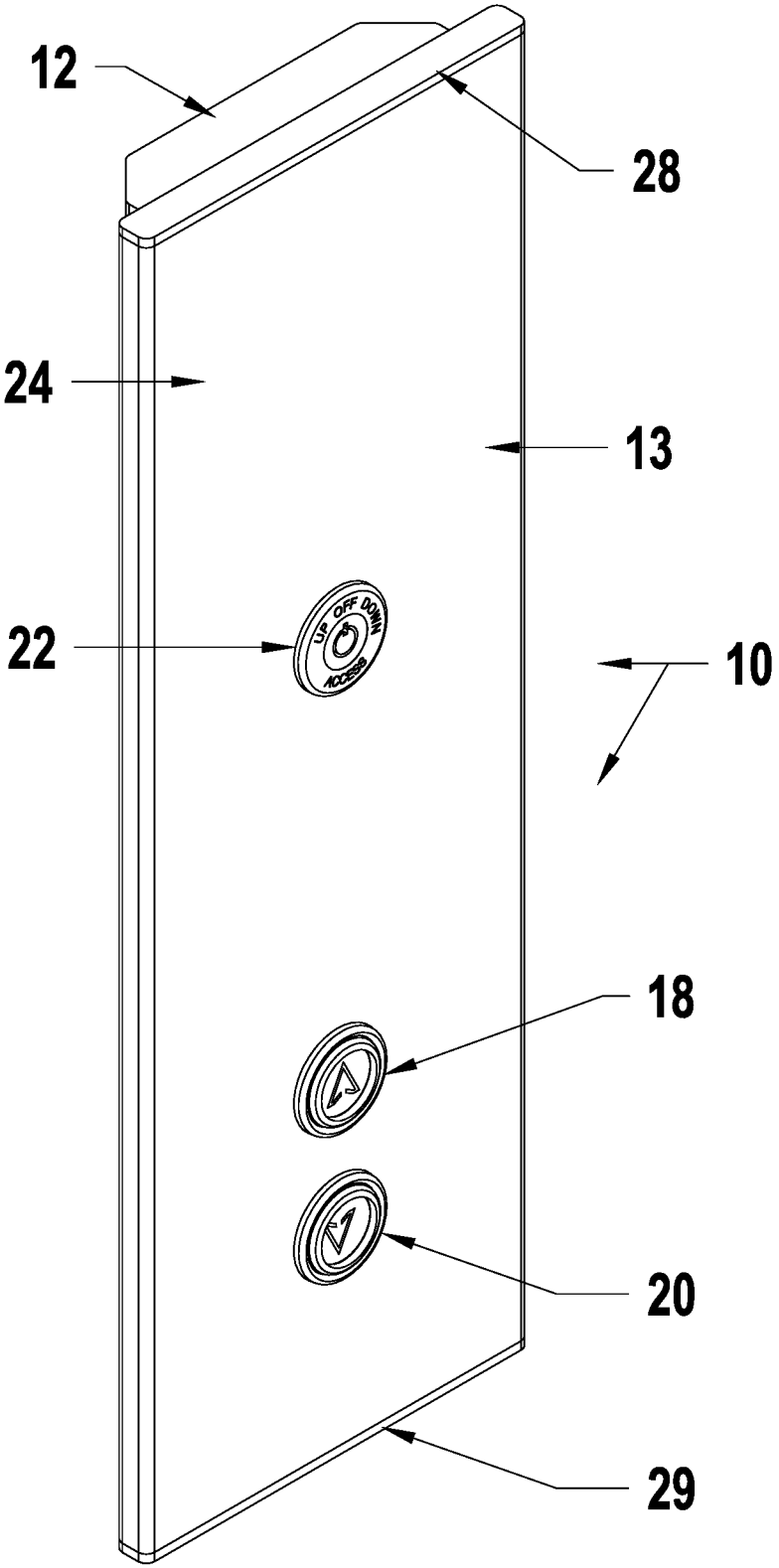
FIG. 1 is a frontal isometric view of our controller, with the access door closed.
Figure 2:
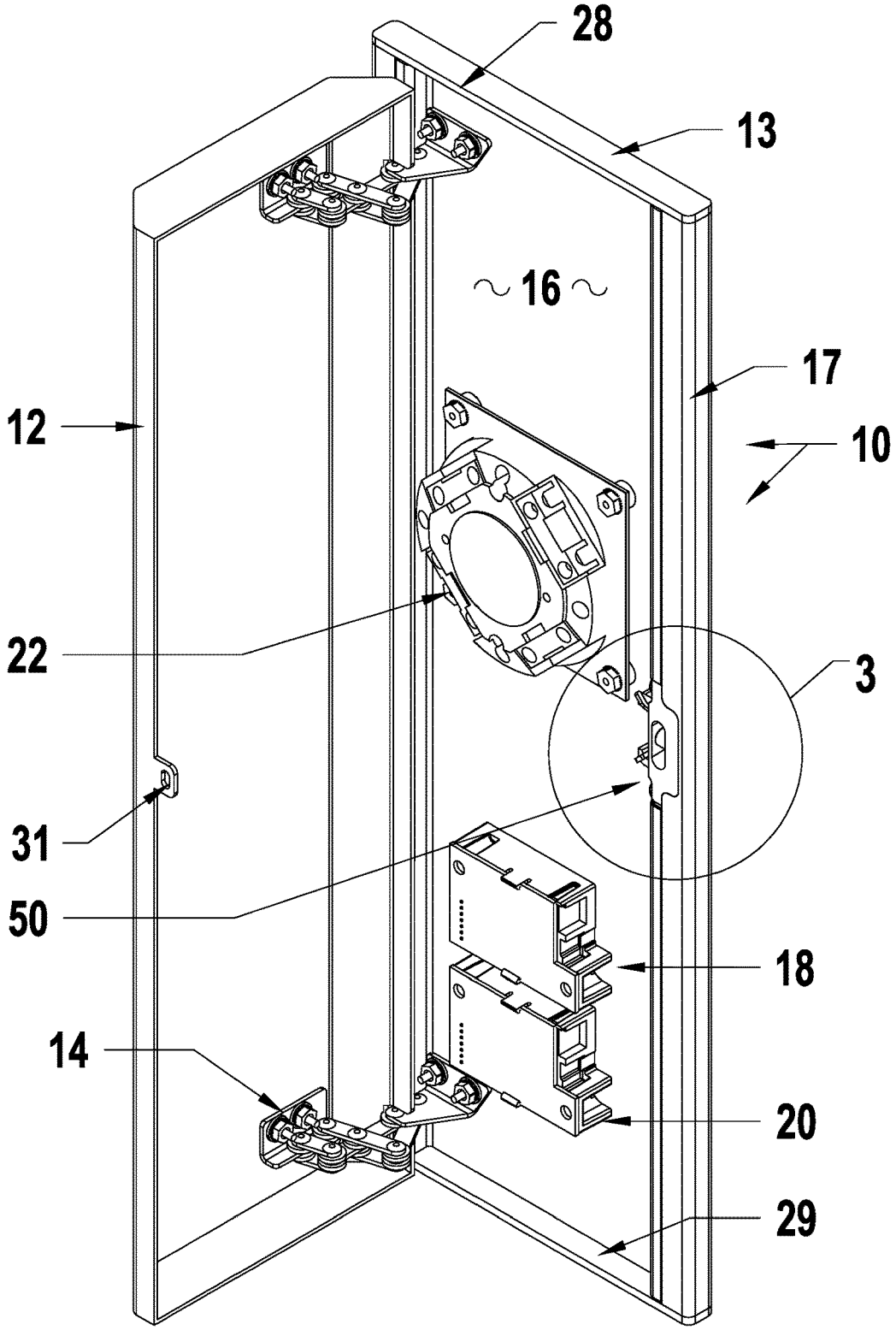
FIG. 2 is an isometric view of the controller with the access door open.
Figure 3:
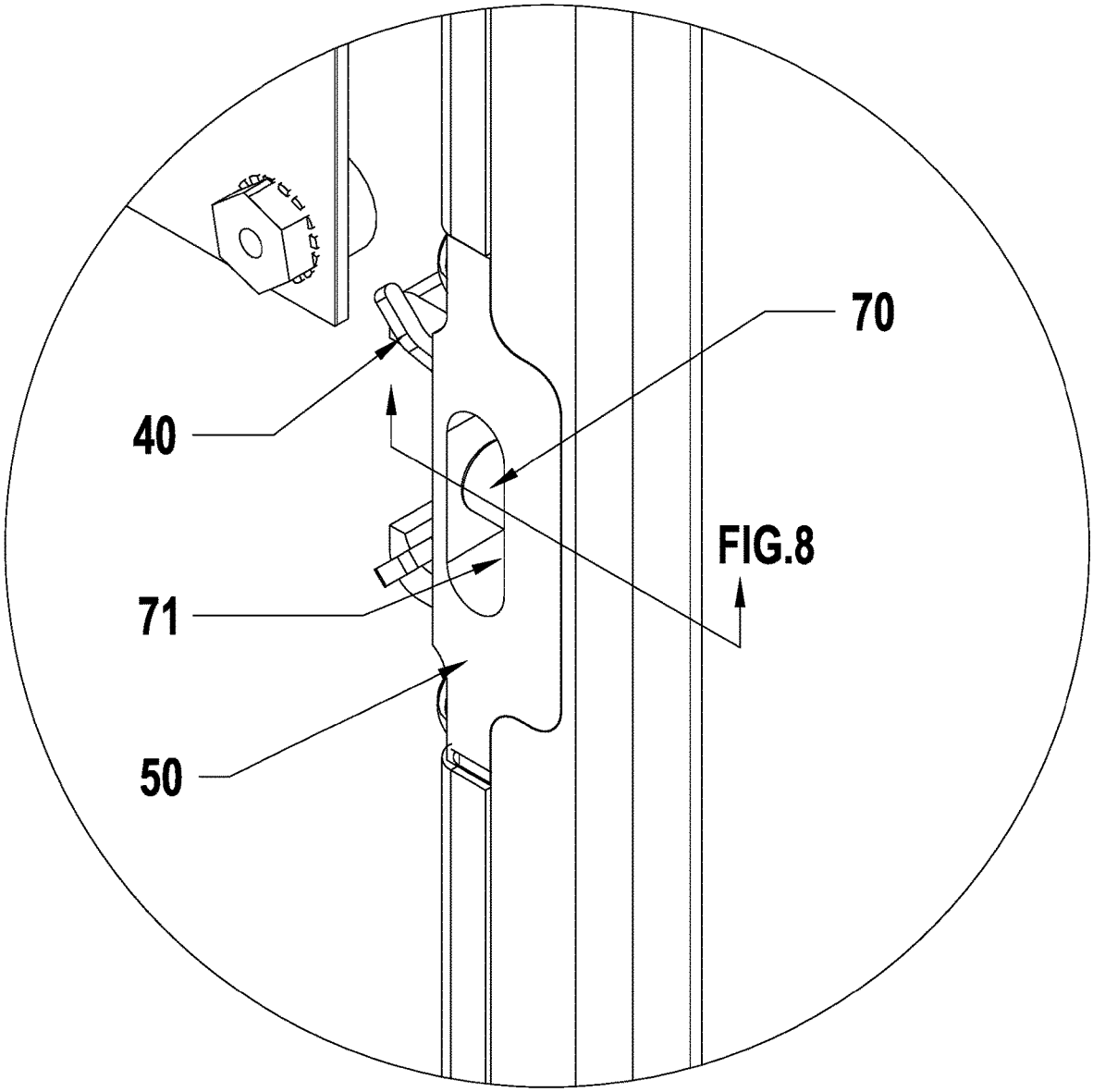
FIG. 3 is an enlarged, fragmentary isometric view derived from the circled region "3" of FIG. 2.
Figure 4:
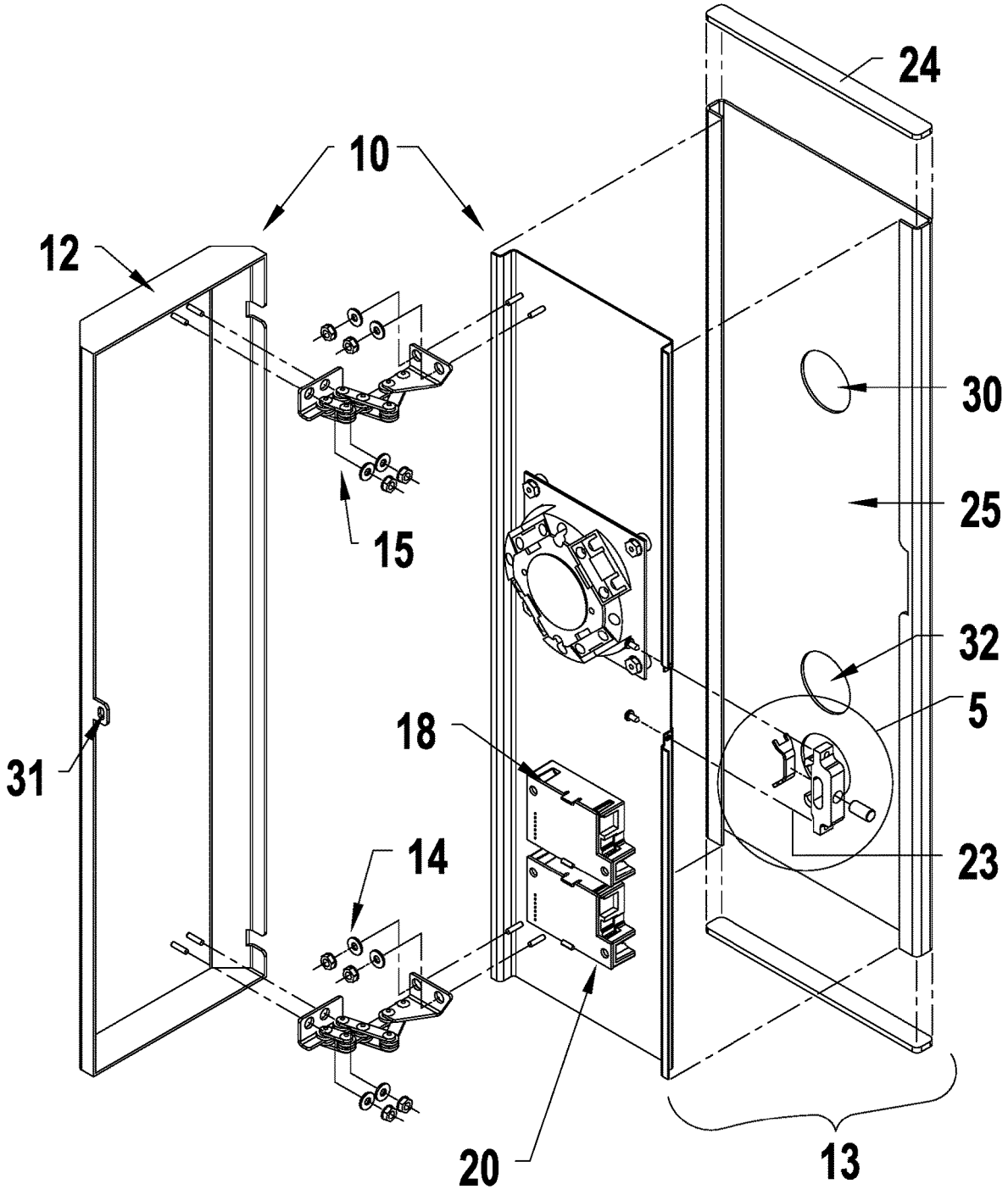
FIG. 4 is a partially exploded, fragmentary, isometric view of the controller.

With initial reference directed now to FIGS. 1, 2 and 4 of the appended drawings, our new and improved elevator fixture comprises a call box 10, that is constructed in accordance with the best mode of the invention. The call box 10 comprises a generally rectangular, supporting mounting plate 12 that is adapted to be secured with suitable fasteners to a convenient supporting surface such as a wall or the like proximate the elevator doors (not shown). A similarly shaped, generally rectangular access door 13 mates with the mounting plate 12 when the call box 10 is shut to enclose the interior of the call box 10. The complimentary access door 13 is somewhat larger than the supporting mounting plate 12, and is pivotally coupled thereto by a pair of spaced-apart, internal hinges 14 and 15. An interiorly disposed, generally rectangular complimentary door subplate 16 supports a set of manually selected, "up" or "down" buttons 18 and 20 which activate electronic micro-switches contained within an optional fireman's key switch 22 of conventional construction. The front of the access door 13 includes a decorative, rectangular faceplate 24 (FIG. 1) bounded by upper and lower end cap portions 28 and 29 respectively that, in cooperation with door edge 17 (FIG. 2), firmly, peripherally engages and encloses the mounting plate 12 when the control box is closed (i.e., the door 13 is shut or closed). A plurality of clearance holes such as orifices 30 and 32 (FIG. 4) and 33 (FIG. 5)) are provided within the for exteriorly exposing key switch 22 and buttons 18 and 20.

Importantly, the mounting plate 12 comprises an outwardly projecting locking tab 31 (FIG. 2) that engages the latching assembly 23. When the access door 13 is closed, tab 31 penetrates an aligned locking recess 71 defined in the block 50 described below, and when the access door 13 is shut, the tab 31 can be secured by a latching assembly magnet such that the door 13 is restrained in the closed position.

Figure 5:
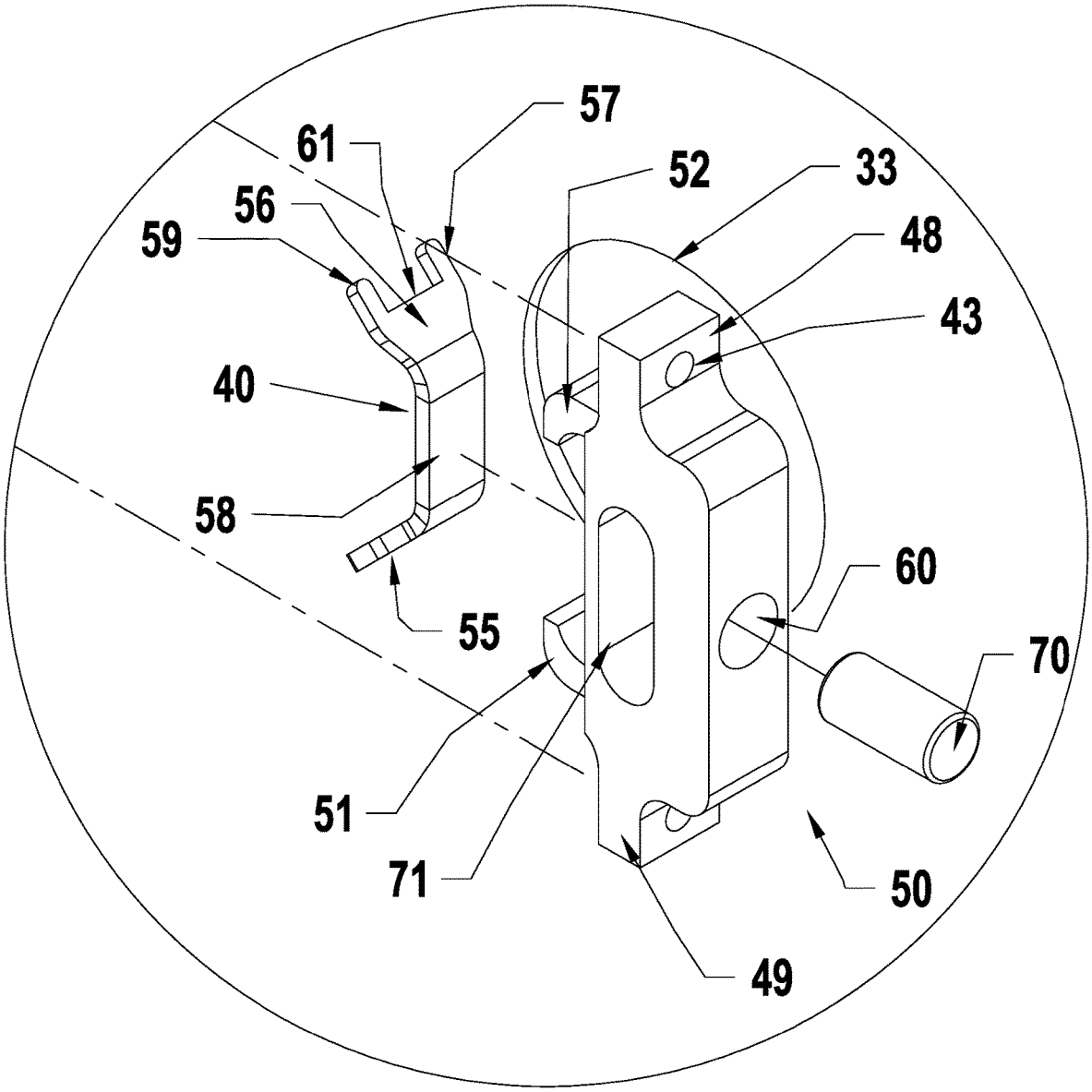
FIG. 5 is an exploded, frontal isometric assembly view of the latching plate assembly, derived from the circled region "5" in FIG. 4.
Figure 6:
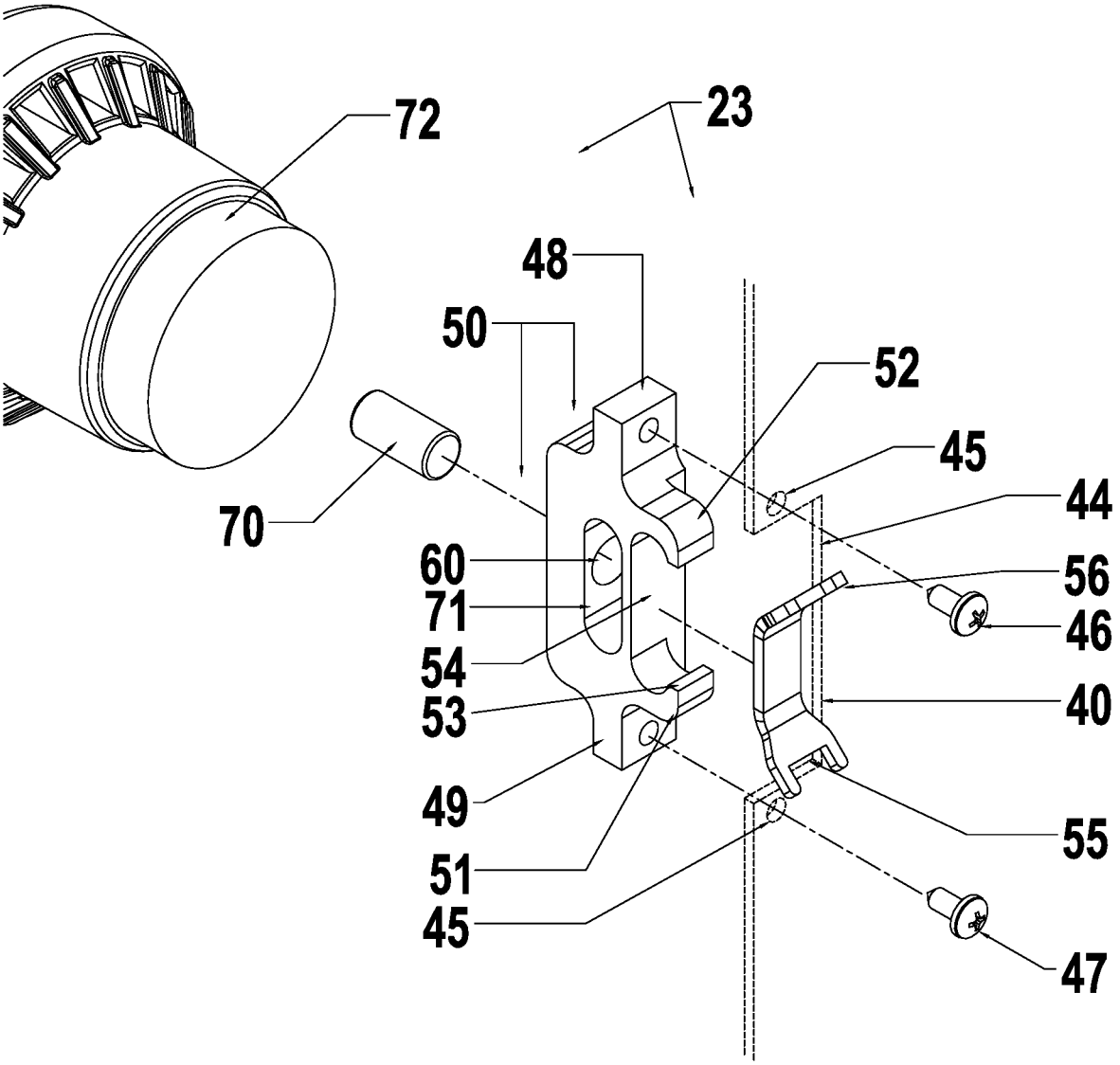
FIG. 6 is an exploded, rear isometric assembly view of the latching plate assembly of FIG. 5.

The latching mechanism 23, best seen in FIGS. 5-8, is preferably mounted on the door adjacent a door relief slot 44 (FIG. 6). Preferably the door carries the latching mechanism, and the mounting plate has a tab engaged by the latching assembly. However, as will be recognized by those skilled in the art, in an alternative embodiment the access door may instead comprise the locking tab, with the latching assembly mounted on the mounting plate for receiving the tab when the door is closed.

The latching assembly comprises a rigid, non-magnetic, preferably aluminum latch block 50 that is secured by a pair of spaced-apart fasteners 46, 47 (FIGS. 6, 7) that penetrate mounting orifices 45 (FIG. 6) and suitable orifices 43 defined in block feet 48 and 49 to secure the block to the access door edge proximate relief slot 44. The block 50 may be made of plastic or non-magnetic metal such as aluminum.

In the best mode known at this time, clip 40 is made of cold-rolled steel. The block 50 is configured such that clip 40 snap-fits to it.

Block 50 has a pair of integral, spaced apart prongs 51 and 52 disposed on opposite ends of an internal, clip-seating clearance slot 54. From a side view each prong forms hook-like profile. The arcuate prongs 51, 52 terminate with in-turned lips 53 (FIGS. 5, 6) that project towards each other. The clip 40 has integral wings 55, 56 that integrally diverge outwardly from a central clip portion 58 (FIG. 5). A notch 61 (FIG. 5) is defined at the end of each clip wing between the wing locks 57, 59. Clip 40 snap-fits into block 50, as the clip wings are compressed between block prongs 51 and 52 in assembly. At this time the clip wing locks 57 and 59 (FIG. 5) are disposed on opposite edges of the block's prong lips 53 (i.e., FIGS. 6, 7), that firmly engage the wings, being seated within wing notches 61.

Block 50 comprises a tunnel-like, through bore 60 disposed between its feet 48 and 49. Bore 60 in block 50 slidably captivates a cylindrical pin magnet 70 that is deflectable in response to a stronger, external magnet 72. In other words pin magnet 70 is yieldably displaceable from its normal position magnetically attracted to the clip 40 to lock the device.

Preferably pin magnet 70 exhibits a three-pound pull, and is normally attracted to clip 40, once the clip is snap-fitted to the block 50. Bore 60 in which the pin magnet 70 is disposed is generally perpendicular to the clip 40 in assembly. When the latching mechanism 23 is approached by the external magnet 72, which is manually handled by a service technician, the internal cylindrical pin magnet 70 will be pulled away from its rest position assumed when the door 13 is closed. Normally pin magnet 70 is attracted to the magnetic clip 40, but it is overcome and displaced by the stronger, hand-held service magnet 72 (FIG. 6). Service magnet 72 will pull pin magnet 70 away from clip 40 to open the access door, providing its north pole, for example, is placed near the south pole of pin magnet 40, or vice versa, to ensure attraction.

Figure 7:
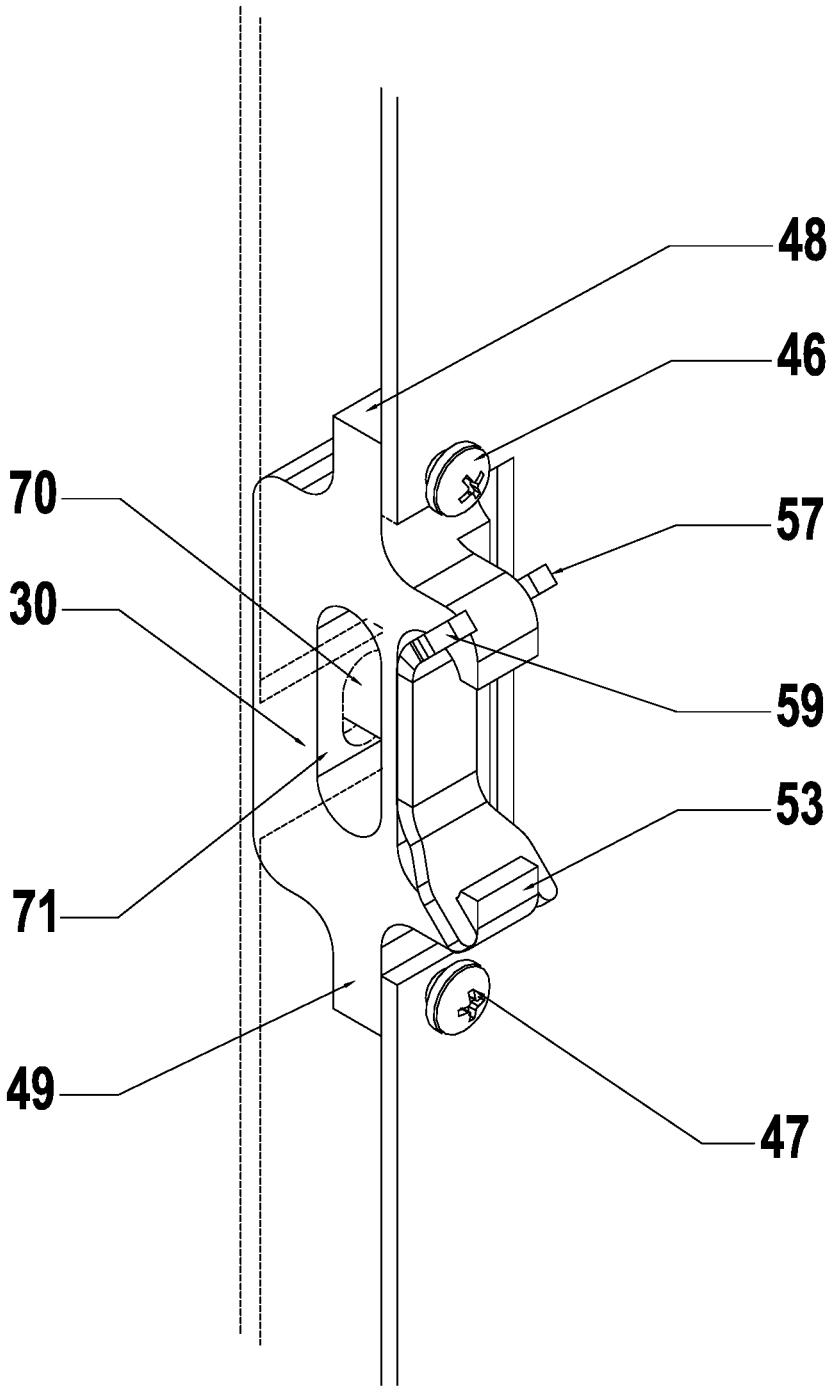
FIG. 7 is a fragmentary, isometric view of the latching mechanism, illustrating the magnetic pin engaging the mounting plate tab.
Figure 8:
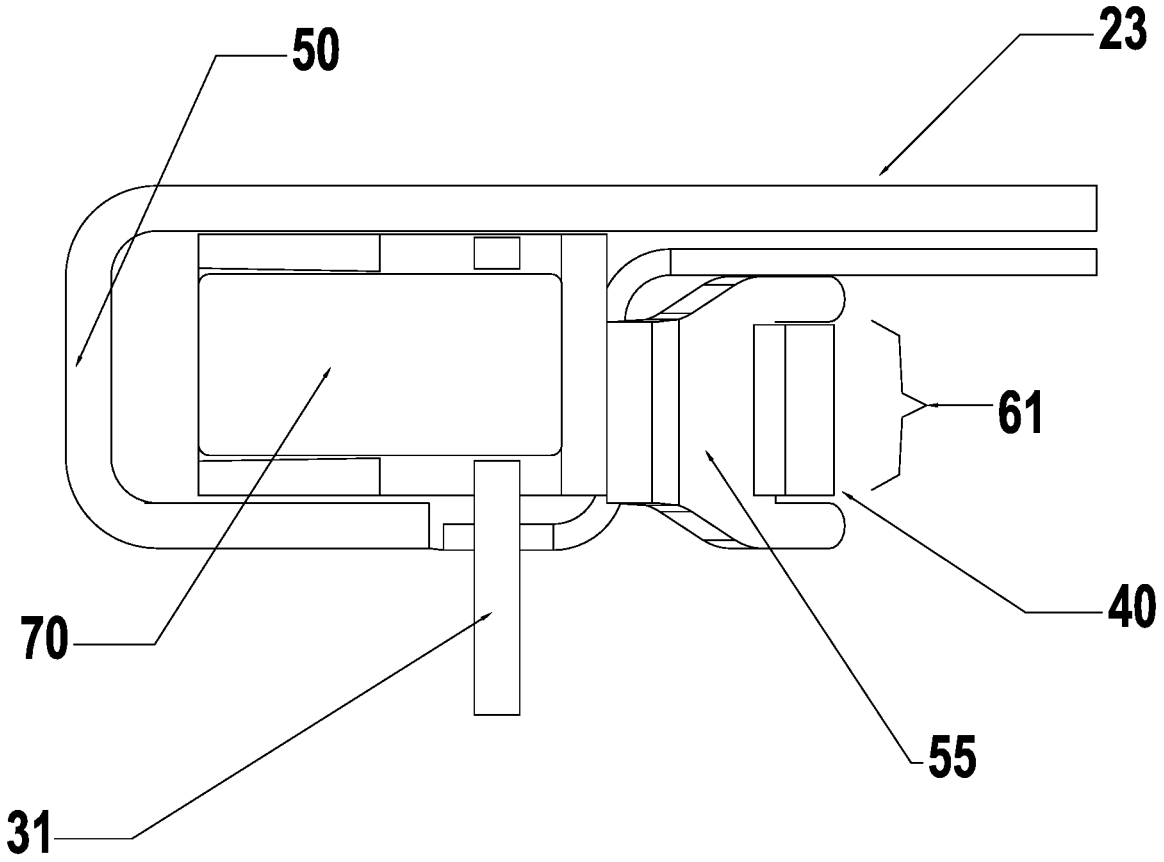
FIG. 8 is a fragmentary bottom sectional view of the latching plate assembly, taken generally along line 8-8 in FIG. 3.
Figure 9:
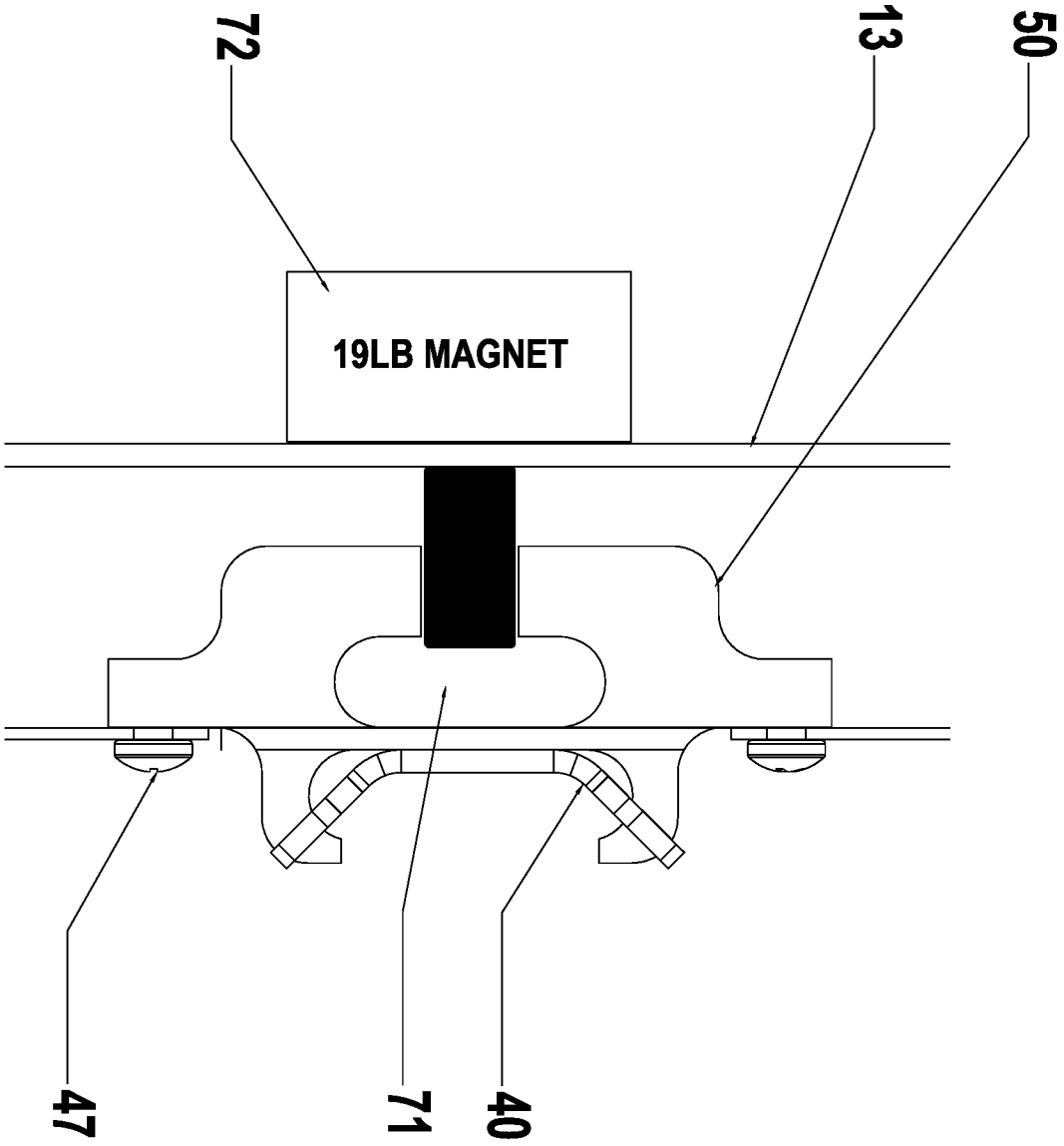
FIG. 9 is a fragmentary diagrammatic view showing the latch in an unlocked position (i.e., permitting the access door to open) with the external magnet positioned near in the internal magnetic locking pin; and, FIG. 10 is a fragmentary diagrammatic view showing the latch locked, with the magnetic locking pin attracted to the clip.
Figure 10:
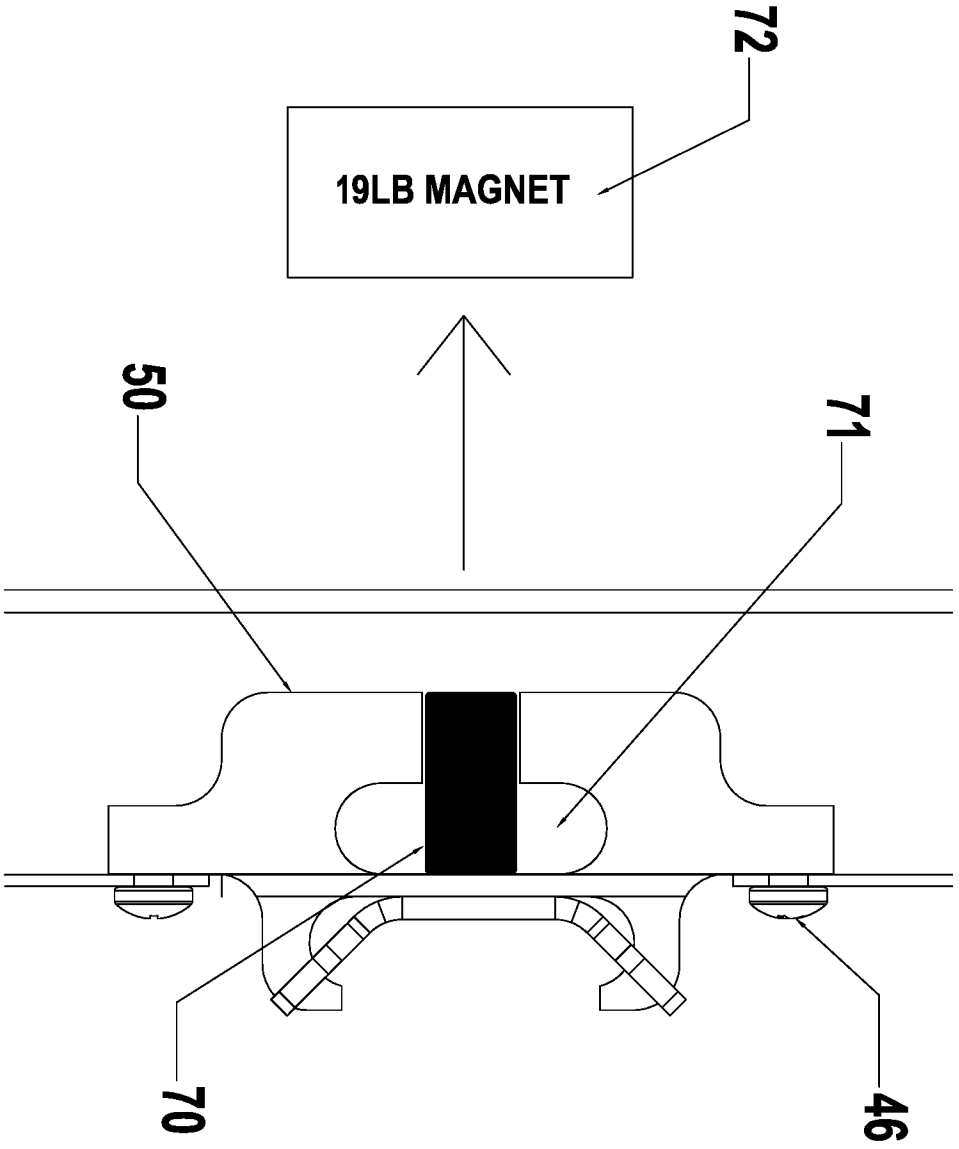

Noting FIGS. 7 and 8, when the access door 13 is closed, the apertured tab 31 projecting from the mounting plate 12 enters a locking recess 71 (i.e., FIGS. 7 and 8) defined in the latching block, which has a somewhat oval profile. Block locking recess 71 is perpendicularly penetrated by a cylindrical, through bore 60 occupied by the sliding magnetic pin 70. When displaced into the locking position, pin 70 penetrates bore 60 and will have entered locking recess 71 (i.e., FIG. 5) to lock the door 13 when it is normally magnetically attracted to clip 40. However, when the stronger and larger external magnet 72 is placed near pin 70 by an operator, the weaker magnet 70 is pulled away from clip 40 within the block 50 (FIG. 9), out of engagement with the mounting plate tab 31 that is positioned within the block's locking recess 71 when the latch is locked. Then the access door may be opened.

Latch "Closed":

Magnetic pin 70 is drawn to the clip 40. The non-magnetic block 50 acts as a guide for the 0.25 inch diameter magnetic pin 70.

Latch "Open"

Magnetic pin 70 is drawn away from the clip 40 via the preferably nineteen pound-force exerted by rare earth magnet 72 carried and used by suitable service personnel. The stronger magnet 72 pulls the pin 70 towards the non-magnetic latch block 50 through orifice 60 (providing the poles of the magnets 70, and 72 are opposite and attractive). The non-magnetic latch block 50 acts as a guide for the 0.25-inch diameter magnetic pin 70.

In order to engage the latch and gain access to the internal components within the elevator call box 10, one must possess prior knowledge of how the locking mechanism functions. A field technician who needs to disengage and then engage the mechanism would use magnet 72 which has both north and south poles and pull strength of no less than nineteen lbs. They would then approach the control housing and with the magnet in hand, apply it to the side of the elevator call box 10 (which is made of non-magnetic material with the exception of the clip 40) until the hand-held magnet 72 moves the magnetic pin 70 inside the control housing towards the clip 40 to which it is attracted, thereby keeping it in place. Thus the latch will remain engaged. When the handheld magnet 72 is again moved to displace the magnetic pin 70 from contact with the clip 40, withdrawing it from tab 31, the latch will unlock and the access door can be opened.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An elevator call box for enclosing electrical control components, the call box comprising:

a mounting plate adapted to be secured to a supporting surface proximate an elevator;

an access door coupled to the mounting plate to enclose the box when the door is shut;

a locking tab;

a latching assembly for locking said door in the closed position and allowing the door to be selectively opened, the latching assembly comprising:

a latch block secured within the call box;

a clip adapted to be snap-fitted to the block;

a through bore penetrating said block;

a locking recess defined in said block;

a pin magnet slidably disposed within said through bore, the pin magnet adapted to penetrate said locking recess;

wherein said locking tab enters said locking recess when said access door is closed;

wherein said pin magnet is normally yieldably magnetically attracted to said clip to engage said locking tab when the door is closed; and, wherein the pin magnet can be displaced magnetically away from said clip to release said tab for opening said door.

2. The call box as defined in claim 1 wherein:

the latch block comprises a clip-seating clearance slot and a pair of integral, spaced apart prongs bordering said slot;

the clip comprises a central portion and a pair of integral, yieldably deflectable wings that integrally diverge outwardly from said central clip portion; and, wherein the clip snap fits into the block as the clip wings are compressed between the block prongs in assembly and the clip central portion is received within the clip-seating clearance slot.

3. The call box as defined in claim 2 wherein the prongs are generally arcuate and they terminate with in-turned lips that project towards each other, and the clip wings terminate in a notch with spaced apart wing locks on either side of said notch.

4. The call box as defined in claim 3 wherein, when the clip is snap-fitted to said block, the clip wings are compressed and retained between the block prongs and the clip wing locks are disposed on opposite edges of the block prong lips.

5. The call box as defined in claim 1 wherein the pin magnet is attracted to said clip with a predetermined force, and the pin magnet can be displaced away from said clip by an external portable magnet that exerts a stronger predetermined force.

6. The call box as defined in claim 1 wherein the locking recess in the block is perpendicularly penetrated by said through bore.

7. An elevator call box for enclosing electrical control components, the call box comprising:

a mounting plate adapted to be secured to a supporting surface proximate an elevator, the mounting plate comprising an outwardly projecting locking tab;

an access door hinged to the mounting plate to enclose the box interior when the door is shut;

a latching assembly mounted on said door for locking said door in the closed position and allowing to be selectively opened, the latching assembly comprising:

a non-magnetic latch block secured within the call box;

a clip adapted to be snap-fitted to the block;

a through bore penetrating said block that is generally perpendicular to the clip;

a locking recess defined in said block that is generally perpendicular to said through bore;

a pin magnet slidably disposed within said through bore, the pin magnet adapted to penetrate said locking recess;

wherein said locking tab enters said locking recess when said access door is closed;

wherein said pin magnet is normally yieldably magnetically attracted to said clip to engage said locking tab when the door is closed; and, wherein the pin magnet can be displaced magnetically away from said clip to release said tab for opening said door.

8. The call box as defined in claim 7 wherein:

the latch block comprises a clip-seating clearance slot and a pair of integral, spaced apart prongs bordering said slot;

the clip comprises a central portion and a pair of integral, yieldably deflectable wings that integrally diverge outwardly from said central clip portion; and, wherein the clip snap fits into the block as the clip wings are compressed between the block prongs in assembly and the clip central portion is received within the clip-seating clearance slot.

9. The call box as defined in claim 8 wherein the prongs are generally arcuate and they terminate with in-turned lips that project towards each other, and the clip wings terminate in a notch with spaced apart wing locks on either side of said notch.

10. The call box as defined in claim 9 wherein, when the clip is snap-fitted to said block, the clip wings are compressed and retained between the block prongs and the clip wing locks are disposed on opposite edges of the block prong lips.

11. The call box as defined in claim 7 wherein the pin magnet is attracted to said clip with a predetermined force, and the pin magnet can be displaced away from said clip to unlock the door by an external portable magnet that exerts a stronger predetermined force.

12. The call box as defined in claim 11 wherein the locking recess in the block is perpendicularly penetrated by said through bore.

13. A latching assembly for elevator control boxes comprising an enclosure with a mounting plate adapted to be secured to a supporting surface proximate an elevator and an access door hinged to the mounting plate, at least one of said mounting plate and said door comprising a projecting locking tab, the latching assembly comprising:

a latch block adapted to be secured within the call box;

a clip adapted to be snap-fitted to the latch block;

a through bore penetrating said block;

a locking recess defined in said block that is generally perpendicular to said through bore;

a pin magnet slidably disposed within said through bore, the pin magnet adapted to penetrate said locking recess;

wherein said locking tab enters said locking recess when said access door is closed;

wherein said pin magnet is normally yieldably magnetically attracted to said clip to engage said locking tab when the door is closed; and, wherein the pin magnet can be displaced magnetically away from said clip to release said tab for opening said door.

14. The latching assembly as defined in claim 13 wherein:

the latch block comprises a clip-seating clearance slot and a pair of integral, spaced apart prongs bordering said slot;

the clip comprises a central portion and a pair of integral, yieldably deflectable wings that integrally diverge outwardly from said central clip portion; and, wherein the clip snap fits into the block as the clip wings are compressed between the block prongs in assembly and the clip central portion is received within the clip-seating clearance slot.

15. The latching assembly as defined in claim 14 wherein the prongs are generally arcuate and they terminate with in-turned lips that project towards each other, and the clip wings terminate in a notch with spaced apart wing locks on either side of said notch.

16. The latching assembly as defined in claim 15 wherein, when the clip is snap-fitted to said block, the clip wings are compressed and retained between the block prongs and the clip wing locks are disposed on opposite edges of the block prong lips.

17. The latching assembly as defined in claim 15 wherein the pin magnet exerts a predetermined force, and the pin magnet can be displaced by an external portable magnet that exerts a stronger predetermined force.

18. The latching assembly as defined in claim 13 wherein the locking tab projects away from said mounting plate.

19. The latching assembly as defined in claim 13 wherein the locking tab projects away from said access door.

* * * * *